United States Patent [19]

McKee et al.

[11] Patent Number: 4,864,911

[45] Date of Patent: Sep. 12, 1989

[54] MUZZLE SWITCH FOR AN ELECTROMAGNETIC LAUNCHER

[75] Inventors: Bobby D. McKee, San Jose; Roald A. Rindal, Roseville, both of Calif.; William C. Condit, Jr., Murrysville, Pa.

[73] Assignee: Westinghouse Electric Corp., Pittsburgh, Pa.

[21] Appl. No.: 175,438

[22] Filed: Mar. 30, 1988

[51] Int. Cl.[4] ..... F41F 1/02

[52] U.S. Cl. ..... 89/8; 124/3

[58] Field of Search ..... 89/8; 124/3; 310/10, 310/11, 12, 13, 14; 318/135

[56] References Cited

U.S. PATENT DOCUMENTS 4,343,223 8/1982 Hawke et al. ..... 89/8

4,572,964 2/1986 Honig ..... 89/8

OTHER PUBLICATIONS

Hawke et al., "Magnetic Propulsion Railguns: Their Design and Capabilities", Megagauss Physics and Technology, Turchi editor, 1980, pp. 297–300.

*Primary Examiner*—Stephen C. Bentley

*Attorney, Agent, or Firm*—D. Schron

[57] ABSTRACT

A muzzle switch connected to the rails of an electromagnetic launcher to divert post-launch rail current into a dump resistor or other load and to prevent arcing at the muzzle. The switch includes shorting members electrically connected to the launcher rails together with a flexible washer-like ring which surrounds the rails and is in close proximity to the shorting members. Part of the rail current is diverted through the ring and when a current carrying armature which propels a payload along the rails passes the switch the interaction of the magnetic field produced by the rail current and current in the ring forces the ring against the shorting members, thus closing the switch as the armature leaves the rails.

5 Claims, 5 Drawing Sheets

MUZZLE SWITCH FOR AN ELECTROMAGNETIC LAUNCHER

BACKGROUND OF THE INVENTION

1. Field of the Invention:

The invention in general relates to electromagnetic launcher systems, and particularly to a novel switch arrangement which is mounted at the launcher barrel near the muzzle end thereof.

2. Description of the Prior Art

One type of electromagnetic launcher known as a rail gun, basically consists of a power supply and two generally parallel electrically conducting rails between which is positioned an electrically conducting armature. Current from the power supply flows down one rail, through the armature and back along the other rail whereby a force is exerted on the armature to accelerate it, and a payload such as a projectile, so as to attain a desired muzzle or exit velocity.

When an armature exits the rail system, the post launch inductive energy remaining in the rail system can be almost equal to the kinetic energy of the projectile and a large arc is produced at the ends of the rails. This arc has enough energy to damage the rails to an extent which may prevent subsequent launches. In order to minimize this arcing, it has been proposed to utilize a muzzle resistor designed to be mounted at the end of the barrel constituted by the rail members to dissipate the energy due to the system inductance as the armature leaves the barrel. A barrel design which incorporates a massive muzzle resistor mounted on the end of the barrel adds fundamental barrel structural and dynamic complications to the launcher system.

In order to eliminate the objectionable muzzle resistor, various electromagnetic launcher systems include an energy dissipating resistor positioned at a more appropriate location than the end of the barrel. For maximum energy dissipation in the resistor and for elimination of the muzzle arc, the arrangement requires a switch at the muzzle end of the barrel to connect the rail system to the energy dissipating resistor when the projectile exits the barrel. The present invention relates to such switch.

SUMMARY OF THE INVENTION

An electromagnetic projectile launcher muzzle switch in accordance with the present invention includes first and second electrically conducting shorting members each connected to a respective one of the rails of the launcher near the muzzle end thereof. A movable conducting member is positioned adjacent the shorting members and in a preferred embodiment is in the form of a flexible deformable ring surrounding the rails. Means are provided for supplying the conducting member with an electrical current whereby during a launch when the driving armature passes the conducting member, the large magnetic field between the rails induced by the high current flowing through the rails interacts with the current through the conducting member to accelerate it so as to make electrical contact with the shorting members to divert the high current away from the armature as it exits the rails.

DESCRIPTION OF THE PREFERRED EMBODIMENT

Figure 1:
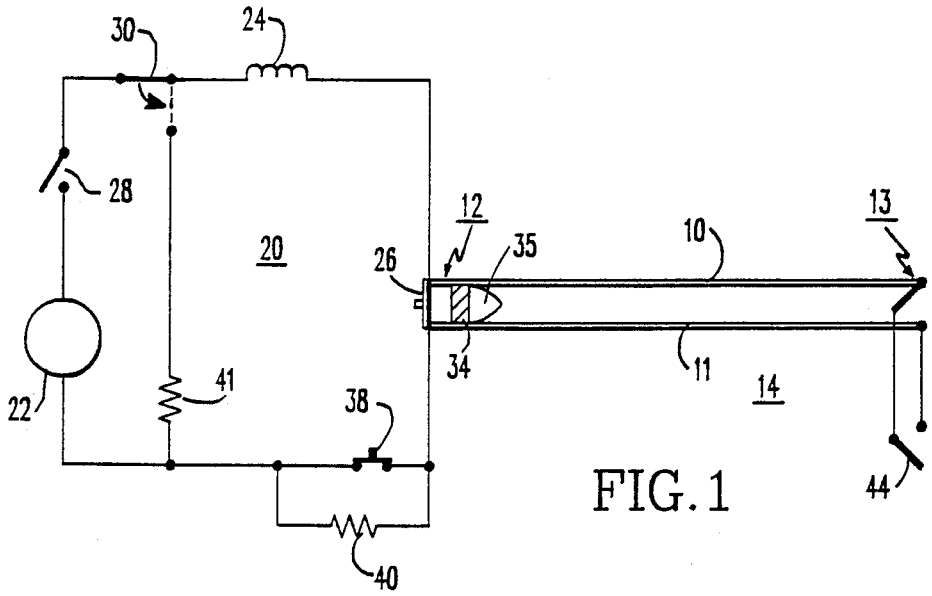
FIG. 1 illustrates, in simplified form, a typical electromagnetic launcher seen as a simple rail gun.

In FIG. 1, there is illustrated an electromagnetic launcher system which includes electrically conducting generally parallel rail members 10 and 11 constituting elements of a launcher barrel 14 and having a breech end 12 and a muzzle end 13. The breech end 12 is connected to a high current source 20 which includes by way of example, a homopolar generator 22 in series with energy storing inductance means such as storage inductor 24. The series connection includes a firing switch 26 which is in a closed condition shorting out the breech end of rails 10 and 11 prior to a launch.

The homopolar generator 22 is driven by a prime mover (not illustrated) and upon attainment of a predetermined rotational speed, switch 28 is closed and the current in inductor 24 is charged up to a firing level while switch 26 is maintained in the closed position and switch 30 is in the solid line position illustrated. When the appropriate current level is attained, firing switch 26 is opened and current is commutated into rails 10 and 11 bridged by an electrically conducting armature 34 which may be of electrically conducting solid or fiber material or, in some cases, a plasma arc.

Upon opening o the firing switch 26, current flows down one rail through the armature and back along the other rail, through normally closed switch 38 back to the homopolar generator. The current flowing in the rails, and through the armature causes the exertion of a force on the armature to thereby accelerate a payload or projectile 35. Accelerating force, in essence, is a function of the magnetic flux density and current density vectors in the vicinity of the armature, and since the current flowing in the rails is often measured in millions of amperes, projectile 35 exits the muzzle end 13 of the barrel at relatively high velocities. After projectile exit from the rails, firing switch 26 is closed and the energy stored in the system after the projectile is launched, is dissipated.

In the arrangement illustrated in FIG. 1, post launch energy dissipation is accomplished with the provision of a main dump resistor 40 which parallels switch 38, and a second dump resistor 41 which parallels homopolar generator 22 when switch 30 is in the dotted line position. In order to conduct the rail current to the dump resistors as the current-carrying armature exits the rails, means are required for short-circuiting the muzzle end of the rails, and for this purpose, a muzzle switch 44 is provided. Although the invention description emphasizes use of an energy dissipating resistor to illustrate the purpose of the muzzle switch, the muzzle switch could be employed in the same manner if the energy dissipating resistor were replaced with another type of a load or energy storage device.

In operation, as the armature 34 is accelerated down the barrel, switch 38 is in a closed position and switch 30 is in the position as indicated by the solid line thereby eliminating both dump resistors 40 and 41 from the circuit. When the current-carrying armature leaves the rails, switch 38 is opened and commutates current through the main dump resistor 40. When the current drops below a predetermined level, switch 30 is placed into the dotted line position so as to take the homopolar generator 22 out of the circuit and allow rotational energy thereof to be conserved, while the remaining current is additionally dissipated in the secondary dump resistor 41.

Figure 2:
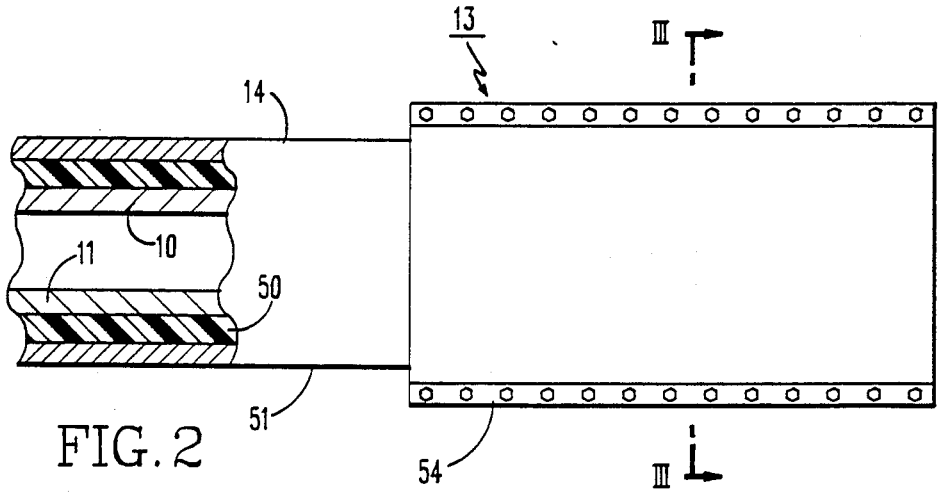
FIG. 2 illustrates a portion of an electromagnetic launcher barrel together with a muzzle switch arrangement.

The barrel 14, illustrated in somewhat more detail in FIG. 2, includes an insulating material 50 surrounding the rails 10 and 11, and shown in the broken away portion, with the material being positioned within an outer containment 51. In accordance with the present invention, at the muzzle end 13, there is positioned a muzzle switch housing 54 which contains the muzzle switch 44 (FIG. 1) further illustrated in FIGS. 3, 4 and 5.

Figure 3:
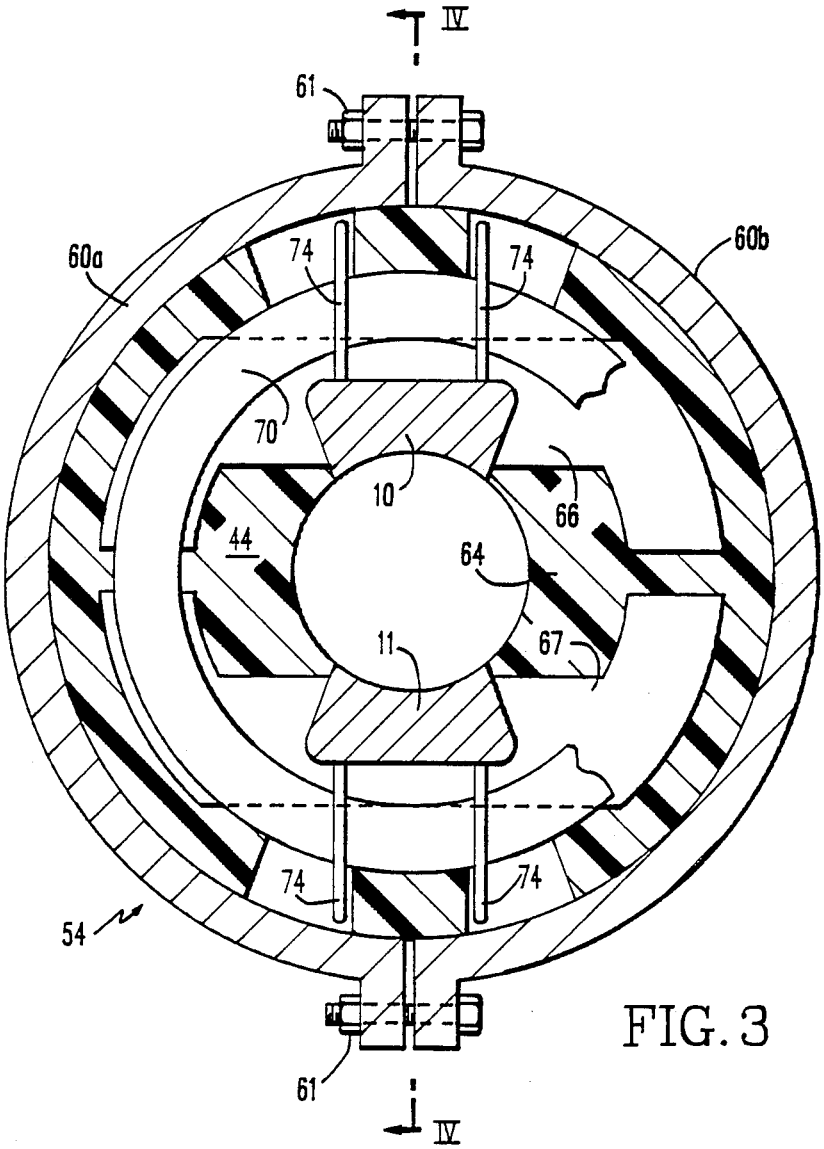
FIG. 3 is a view along line III—III of FIG. 2.

FIG. 3 is a view along line III—III of FIG. 2 looking toward the muzzle end of the rails 10 and 11. The housing 54 includes sidewalls 60*a* and 60*b* joined together by means of fasteners 61 and operative as a containment for rigid insulating material 64 as well as the muzzle switch 44. Muzzle switch 44 includes first and second electrically conducting shorting members 66 and 67 each connected to a respective one of the rails 10 and 11. A movable electrically conducting member is positioned adjacent the shorting members 66 and 67 and in the embodiment illustrated takes the form of a relatively flexible, flat ring 70 (a portion of which has been broken away) surrounding the rails 10 and 11. The ring 70 is electrically connected to the rail members by means of electrically conducting spring members 74 best seen in FIG. 4 which is a view along line IV—IV of FIG. 3.

Figure 4:
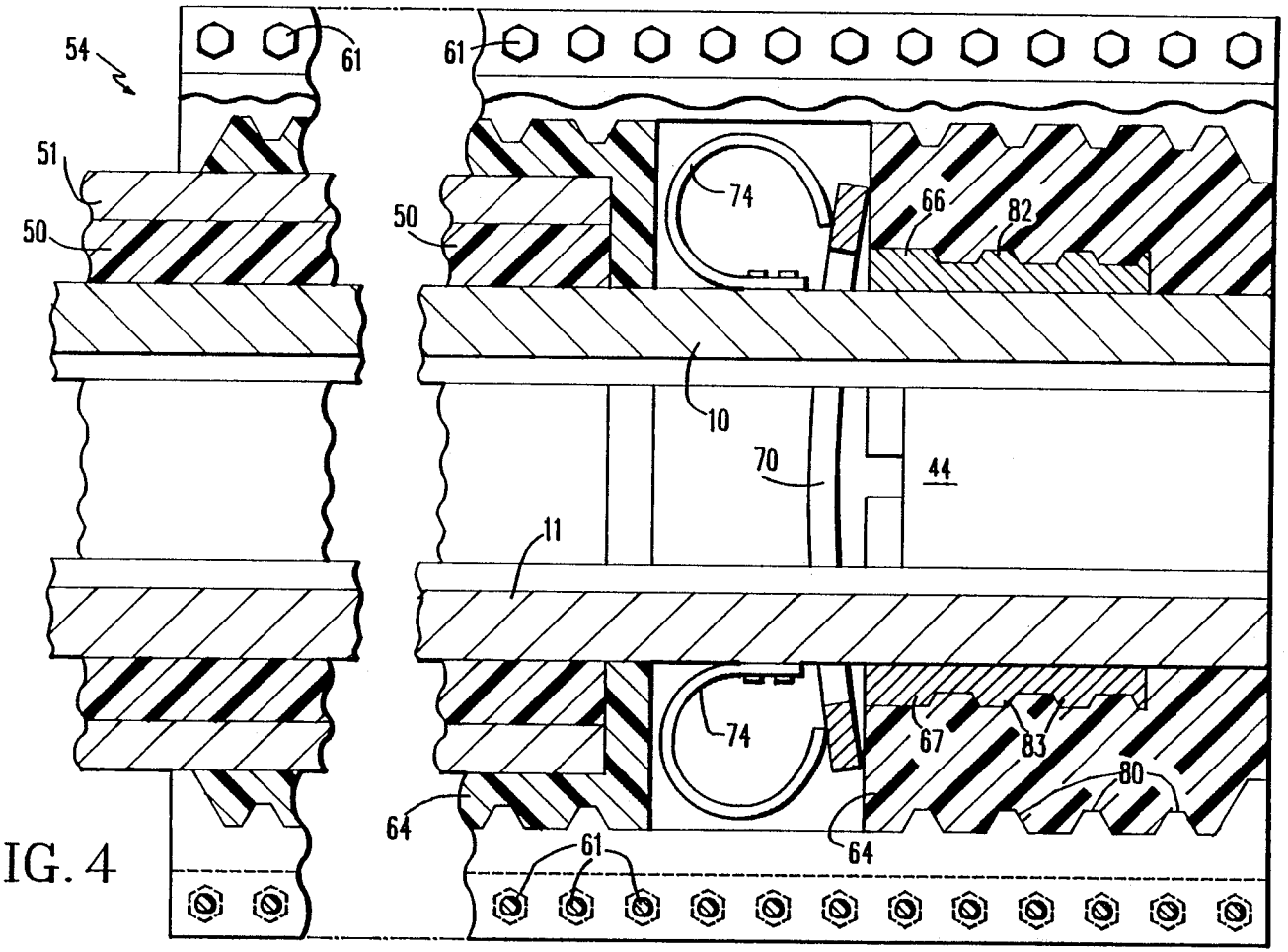
FIG. 4 is a view along line IV—IV of FIG. 3.

FIG. 4 further illustrates the proximity of the ring 70 relative to the shorting members 66 and 67. Ring 70 is relatively flexible and as illustrated in FIG. 4 is slightly bowed away from the shorting members.

The containment wall may contain teeth 80 which interlocks with the insulation 64 so as to assist in preventing any relative longitudinal movement. In this regard, shorting members 66 and 67 also include tooth portions 82 and 83 for insulation interlocking purposes.

Figure 5:
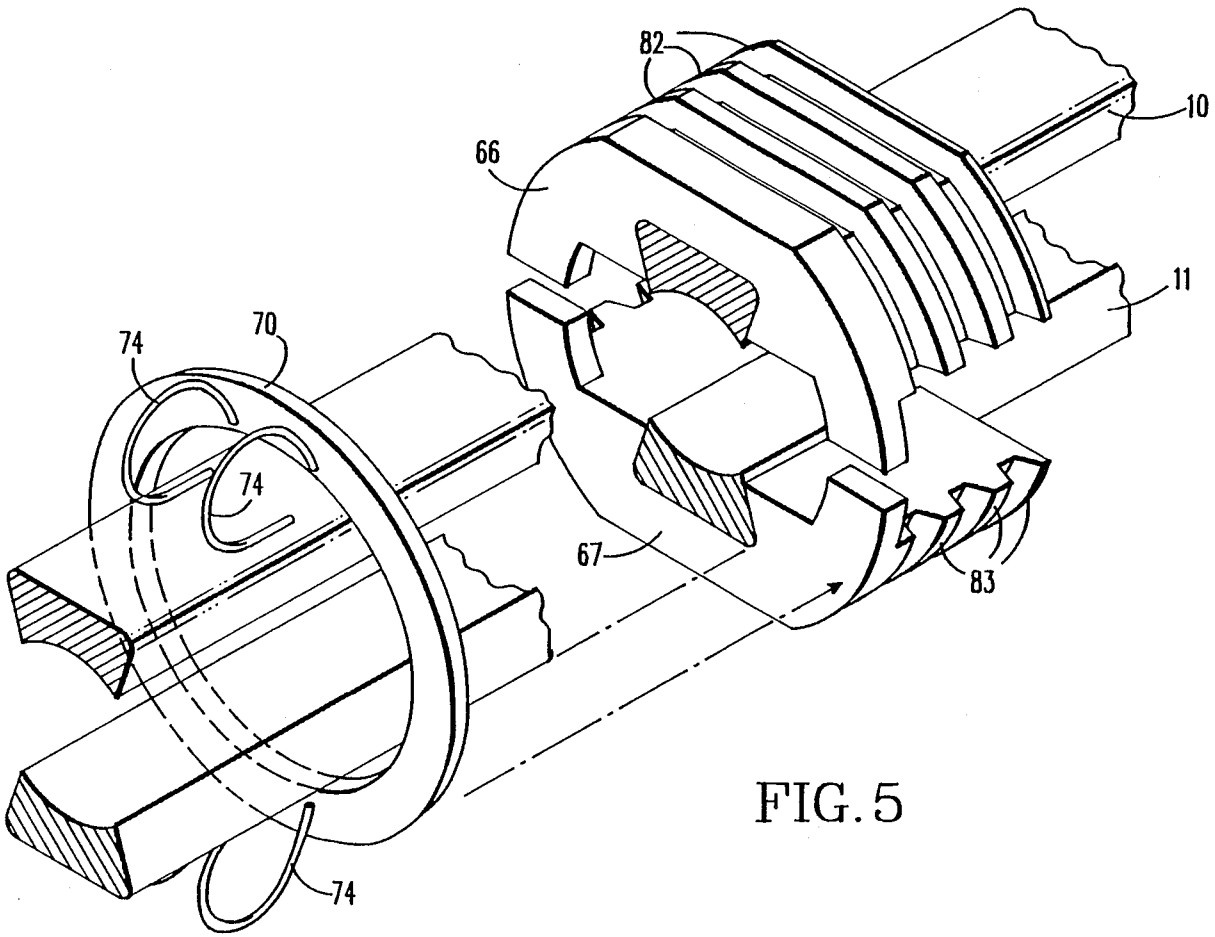
FIG. 5 is a simplified exploded isometric view of the basic components of a muzzle switch assembly in accordance with one embodiment of the present invention.

A general overall perspective of the basic elements of the muzzle switch is illustrated in the isometric view of FIG. 5 wherein ring 70, movable between the solid line and dotted line positions, is illustrated in an exploded view displaced from the shorting member 66 and 67. Operation of the muzzle switch may be explained with further reference to FIGS. 6A through 6C illustrating the components in elemental form.

Figure 6A:
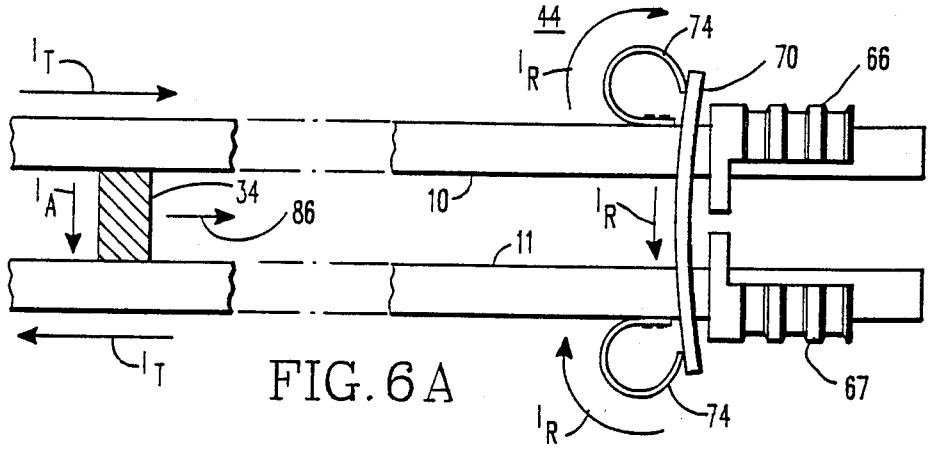
FIGS. 6A through 6C illustrate the operation of the muzzle switch assembly during a launch.

In FIG. 6A, $I_T$ represents the total current provided by the high current power supply and which is commutated into the rails upon opening of the firing switch. A major portion of this current, for example, 95% flows through the armature and is represented by current arrow $I_A$. As previously explained, the current flowing in the rails creates a high magnetic field behind the armature and the reaction of this magnetic field with the armature current causes a high accelerating force on the armature to propel it in the direction of arrow 86. The remainder of the current $I_R$ flows into ring 70 from rail 10 by means of the upper ring members 74, and flows into rail 11 from the ring by means of the lower spring members 74. At this point in time, the magnetic field in the muzzle switch area is negligible.

Figure 6B:
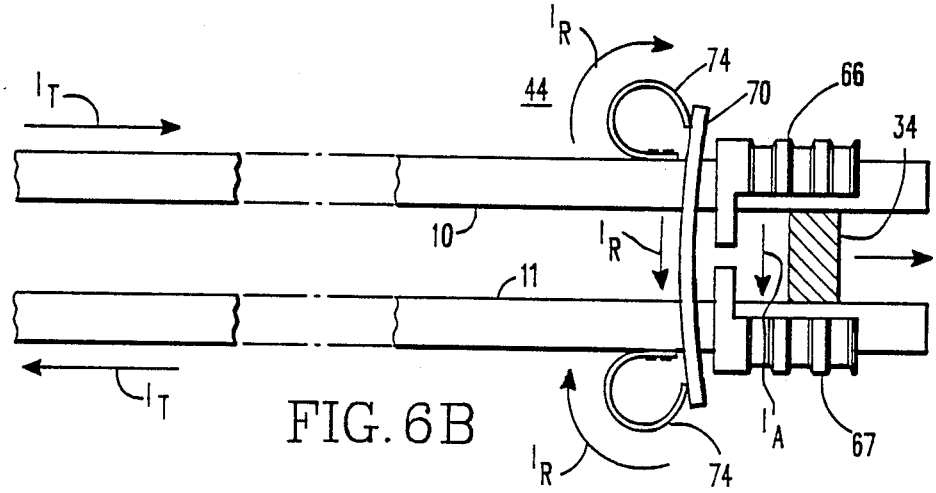
Figure 6C:
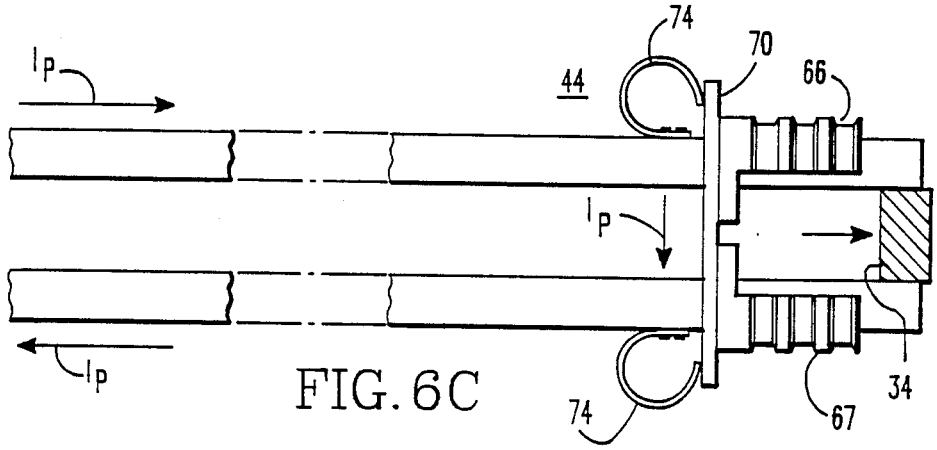

FIG. 6B illustrates the armature 34 just after passing the muzzle switch. At this point, the rail current is inducing a high magnetic field in the muzzle switch area and this high magnetic field is interacting with the ring current $I_R$ producing a force on it tending to accelerate it in the same direction as armature travel. The ring 70, which may be of flexible aluminum, is thus forced into contact with the shorting member 66 and 77, with contact being made just as armature 34 exits the rail system, as illustrated in FIG. 6C. Upon ring contact with the shorting members, substantially all of the post-launch rail current designated $I_P$ is diverted through the ring so that the armature exits the rails with little or no current flow therethrough such that arcing is minimized or entirely eliminated at the ends of the rails.

Current flow due to energy remaining the rail system is thereafter, by virtue of the closing of muzzle switch 44, diverted to the dump resistors illustrated in FIG. 1. When the magnetic field in the muzzle switch area decreases due to decreasing post-launch rail current, ring 70 will spring back to the orientation as illustrated in FIG. 6A, so as to be primed for a subsequent launch.

It is seen therefore that a relatively simple muzzle switch has been provided which can be used in a multiple launch scenario for conducting residual energy to a distant location for dissipation in dump resistors. Interaction of the magnetic field caused by rail current with current through the ring causes its acceleration so as to come into contact with the shorting members. In the embodiment illustrated, the current to the disc is provided by the arrangement including the electrically conducting spring member 74, although it is to be understood that other ring current providing means may be utilized.

We claim:

1. A muzzle switch for an electromagnetic projectile launcher having a pair of electrically conducting rails bridged by a projectile accelerating armature provided with current from a high current source, comprising:

(A) first and second electrically conducting shorting members, each connected to a respective one of said rails near the muzzle end thereof;

(B) a moveable electrically conducting member positioned adjacent said shorting members;

(C) means for providing said conducting member with an electrical current, whereby when said armature passes said conducting member, the large magnetic field between said rails induced by the high current therethrough interacts with the current through said conducting member to accelerate it so as to make electrical contact with said shorting members to divert rail current away from said armature as it exits said rails.

2. Apparatus according to claim 1 wherein:

(A) said moveable electrically conducting member is a flat ring which surrounds said rails.

3. Apparatus according to claim 2 wherein:

(A) said ring is of aluminum.

4. Apparatus according to claim 1 wherein:

(A) said moveable electrically conducting member is provided with a small portion of the current in said rails provided by said current source.

5. Apparatus according to claim 4 wherein:

(A) said means for providing includes a plurality of electrically conducting spring members connected to said rails and to said moveable electrically conducting member.

* * * * *